US006823593B2

(12) United States Patent
Dunn-Rankin

(10) Patent No.: US 6,823,593 B2
(45) Date of Patent: Nov. 30, 2004

(54) SERRATED CUTTING BLADE

(76) Inventor: Michael Dunn-Rankin, 502 Warwick Dr., Venice, FL (US) 34293

( * ) Notice: Subject to any disclaimer, the term of this patent is extended or adjusted under 35 U.S.C. 154(b) by 0 days.

(21) Appl. No.: 10/368,319

(22) Filed: Feb. 18, 2003

(65) Prior Publication Data

US 2004/0158995 A1 Aug. 19, 2004

(51) Int. Cl.[7] ..... B26B 21/56

(52) U.S. Cl. ..... 30/346.56; 30/346.61; 30/355

(58) Field of Search ..... 30/162, 166.3, 30/346.61, 351, 355, 357, 346, 502, 346.55, 346.56; 83/849, 835, 855; D8/20

(56) References Cited

U.S. PATENT DOCUMENTS

| | | | | | |
|---|---|---|---|---|---|
| 408,669 | A | * | 8/1889 | Prescott | 83/835 |
| 1,882,328 | A | * | 10/1932 | Heinrich | 83/835 |
| 1,911,974 | A | | 5/1933 | Shelton | |
| 1,961,132 | A | | 6/1934 | Behrman | |
| 2,265,012 | A | | 12/1941 | Earp-Thomas | |
| 2,291,439 | A | | 7/1942 | Andis | |
| 2,790,283 | A | | 4/1957 | Spencer | |
| 3,017,908 | A | * | 1/1962 | Higbee | 83/835 |
| 3,111,970 | A | * | 11/1963 | Lou Priest et al. | 83/855 |
| 3,171,457 | A | * | 3/1965 | Brown | 83/849 |
| 3,555,682 | A | | 1/1971 | Laszlo | |
| 3,824,887 | A | | 7/1974 | Marchard | |
| 3,828,631 | A | | 8/1974 | Spengler et al. | |
| 4,203,214 | A | | 5/1980 | Fogle | |
| 4,286,383 | A | | 9/1981 | Farden | |
| 4,563,814 | A | | 1/1986 | Trichell et al. | |
| 4,707,920 | A | | 11/1987 | Montgomery | |
| 4,759,092 | A | | 7/1988 | Duddy | |
| 4,884,307 | A | | 12/1989 | Flood | |
| 5,306,285 | A | | 4/1994 | Miller et al. | |
| 5,423,845 | A | | 6/1995 | McDaniel | |
| 5,495,670 | A | | 3/1996 | Quinn | |
| 5,579,581 | A | | 12/1996 | Melton | |
| D400,412 | S | * | 11/1998 | Gold | D8/20 |
| 5,875,551 | A | | 3/1999 | Huang | |
| 5,906,050 | A | | 5/1999 | Gilbert | |
| 6,000,136 | A | | 12/1999 | Owens | |
| D445,057 | S | * | 7/2001 | Chanaratsopon et al. | D11/27 |
| D448,634 | S | * | 10/2001 | Hickman | D8/20 |

FOREIGN PATENT DOCUMENTS

| | | |
|---|---|---|
| GB | 2094698 A | 9/1982 |
| JP | 54-106351 | 8/1979 |

* cited by examiner

*Primary Examiner*—Hwei-Siu Payer
(74) *Attorney, Agent, or Firm*—David W. Pettis, Jr., P.A.

(57) ABSTRACT

An improved serrated cutting blade is characterized by the shape and positioning of the sharpened teeth of the cutting edge. In preferred embodiments the blade may be used in combination with a handle or holder such as that typically referred to as a utility knife or box cutter.

18 Claims, 6 Drawing Sheets

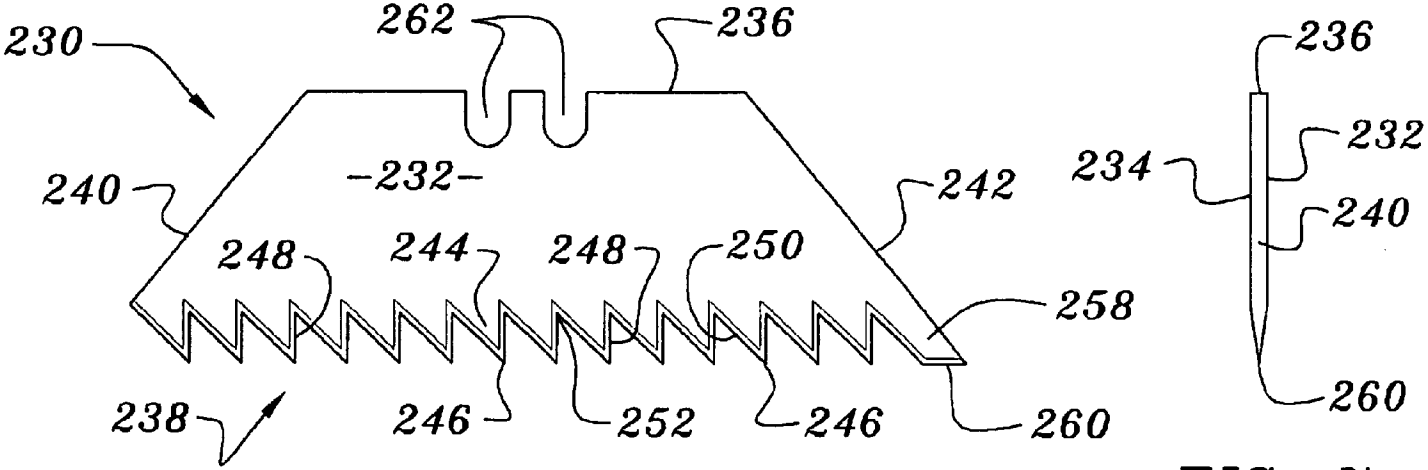
FIG. 7
FIG. 6
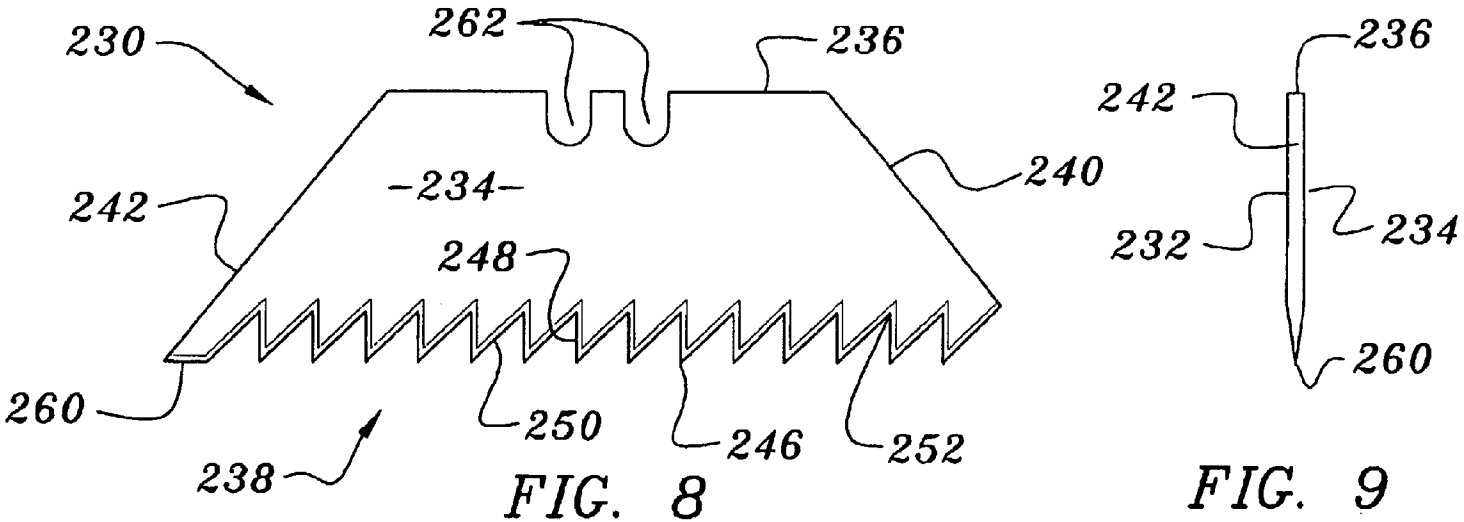
FIG. 9
FIG. 8

SERRATED CUTTING BLADE

BACKGROUND OF INVENTION

1. Field of the Invention

The present invention relates to a serrated cutting blade uniquely characterized by the shape and positioning of the sharpened teeth of the cutting edge. In a series of preferred embodiments, the blade of this invention is described as being particularly useful in combination with holders generally referred to as utility knives. However, it is to be understood that there is no intention of limiting the scope of the present invention to its utility in combination with such holders.

2. Description of the Prior Art

Your inventor readily acknowledges that serrated cutting edges for various implements are old and well-known in the prior art. Such cutting edges are, perhaps, most frequently encountered with regard to table knives and meat cutting knives and a wide variety of saw blades, straight, circular, and band.

However, other than such saw blades, serrated cutting devices have not proved particularly useful in industrial applications such as, for example, hand cutting of sheet rock, roofing shingles, cardboard, carpet and other flooring materials, and items formed from plastic. Presently, virtually all such hand cutting is accomplished by devices typically referred to as utility knives or box cutters that employ a disposable, single-edge blade as the cutting implement. In fact, the cutting implement of many such current utility knives basically comprises a single edge razor blade.

While current state-of-art utility knives using such cutting blades are certainly functional, actual use by this inventor confirms that the straight edge blades dull quickly and often cut poorly, resulting in cutting operators that are tedious and time consuming. In fact, actual experience confirms that such poor cuts are sometimes made so that excessive waste results, due to poor and/or inaccurate cuts made with start-of-the-art knives.

It is therefore clear that there remains a need in the art for an improved serrated cutting blade, preferably usable in combination with current utility knives and box cutters, that will permit more accurate and efficient hand cutting of materials such as those identified above because the improved serrated blade of this invention remains sharper during use than conventional straight edge blades.

SUMMARY OF THE INVENTION

The present invention relates to an improved serrated cutting blade of a type which may be used in combination with a handle or holder, typically referred to as a utility knife or box cutter. However, it is to be noted that such utility is not to be interpreted as limiting the scope of the present invention.

The blade is characterized by its construction comprising a body formed from a relatively thin and substantially flat metal material. The bottom edge of the body comprises a plurality of sharpened teeth with adjacent ones of the teeth defining a valley therebetween. Each of the teeth has a distal end extending away from the body, and a line connecting each of the distal ends actually defines the bottom edge of the blade. Of special note is the fact that the valleys between adjacent teeth are defined by the intersection of a first serration side of one tooth and a second serration side of an adjacent tooth. The angle of the first serration sides is less than the angle of the second serration sides, with those angles being measured with respect to a plane normal to the bottom edge between the adjacent teeth forming the valley.

It is primarily the unique shape and positioning of the sharpened teeth that provide for the improved cutting characteristics demonstrated by the blade of this invention. Further details of the construction and examples of various preferred embodiments of the blade of this invention are presented below.

The invention accordingly comprises an article of manufacture possessing the features, properties, and the relation of elements which will be exemplified in the articles hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 6 is a front plan view of a second embodiment of the blade of this invention.

FIG. 7 is a left side elevation of the blade shown in FIG. 6.

FIG. 8 is a back plan view of the blade shown in FIG. 6.

FIG. 9 is a left side elevation of the blade shown in FIG. 8.

Similar reference characters refer to similar parts throughout the several views of the drawings.

DETAILED DESCRIPTION OF THE INVENTION

Figure 1:
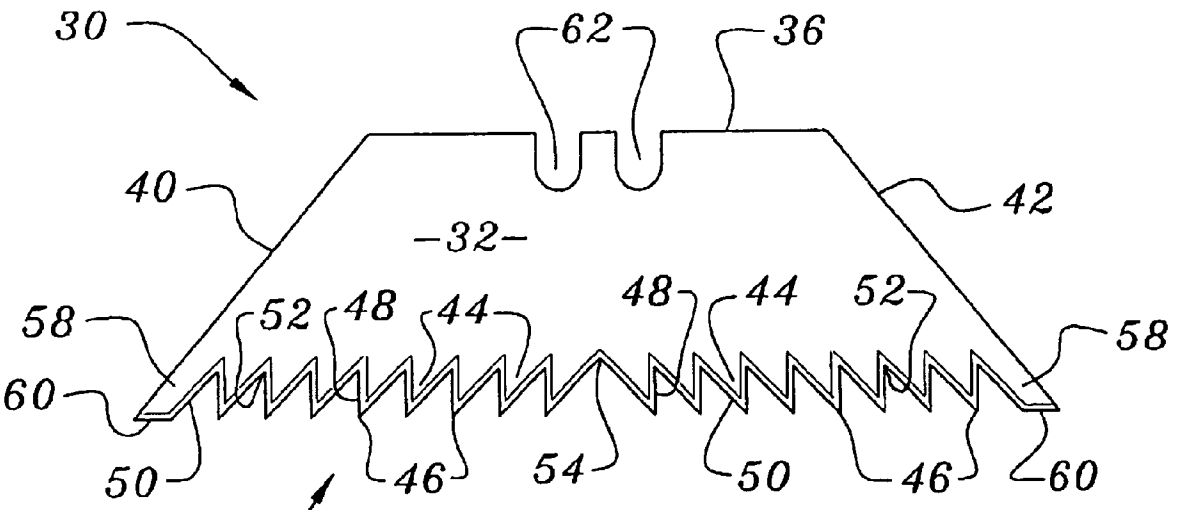
FIG. 1 is a front plan view of a first embodiment of the blade of this invention.
Figure 2:
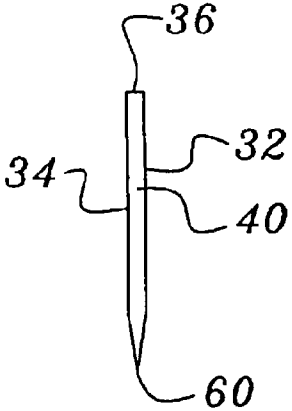
FIG. 2 is a left side elevation of the blade shown in FIG. 1.
Figure 3:
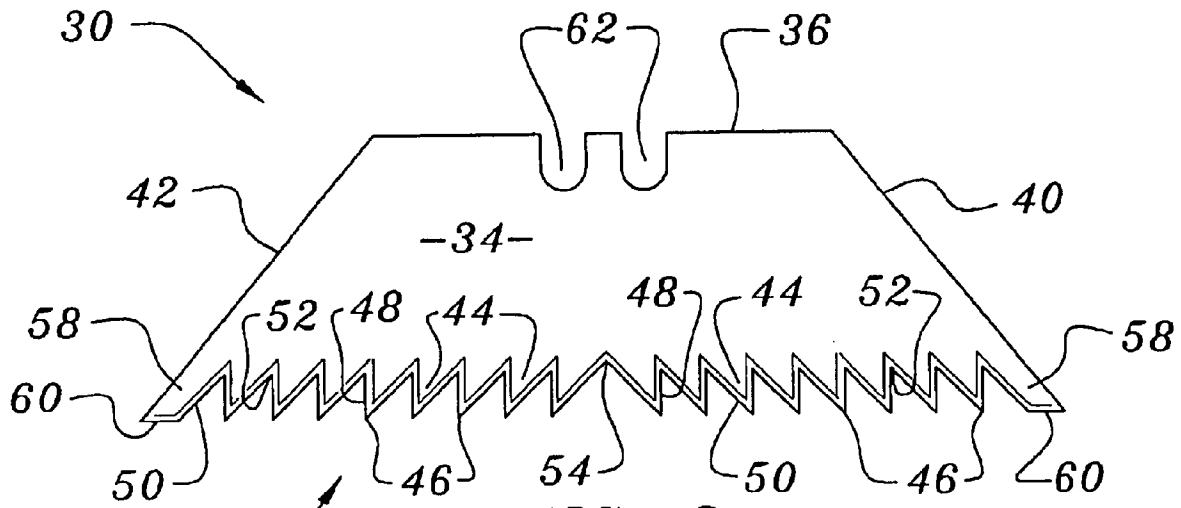
FIG. 3 is a back plan view of the blade shown in FIG. 1.
Figure 4:
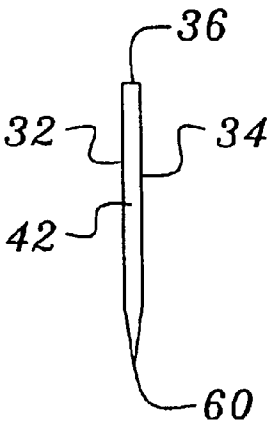
FIG. 4 is a left side elevation of the blade shown in FIG. 3.

The first embodiment for the improved serrated cutting blade of this invention is illustrated in the views of FIGS. 1 through 5, and comprises a body generally indicated as 30. Body 30 is defined by a front surface 32, a back surface 34, a top edge 36, a bottom edge generally indicated as 38, a left side 40, and a right side 42. Bottom edge 38 comprises a plurality of sharpened teeth 44, each of the teeth 44 having a distal end 46 extending away from body 30 such that a line connecting each of the distal ends 46 actually defines bottom edge 38. Each of the teeth 44 comprises a first serration side 48 and a second serration side 50.

Figure 5:
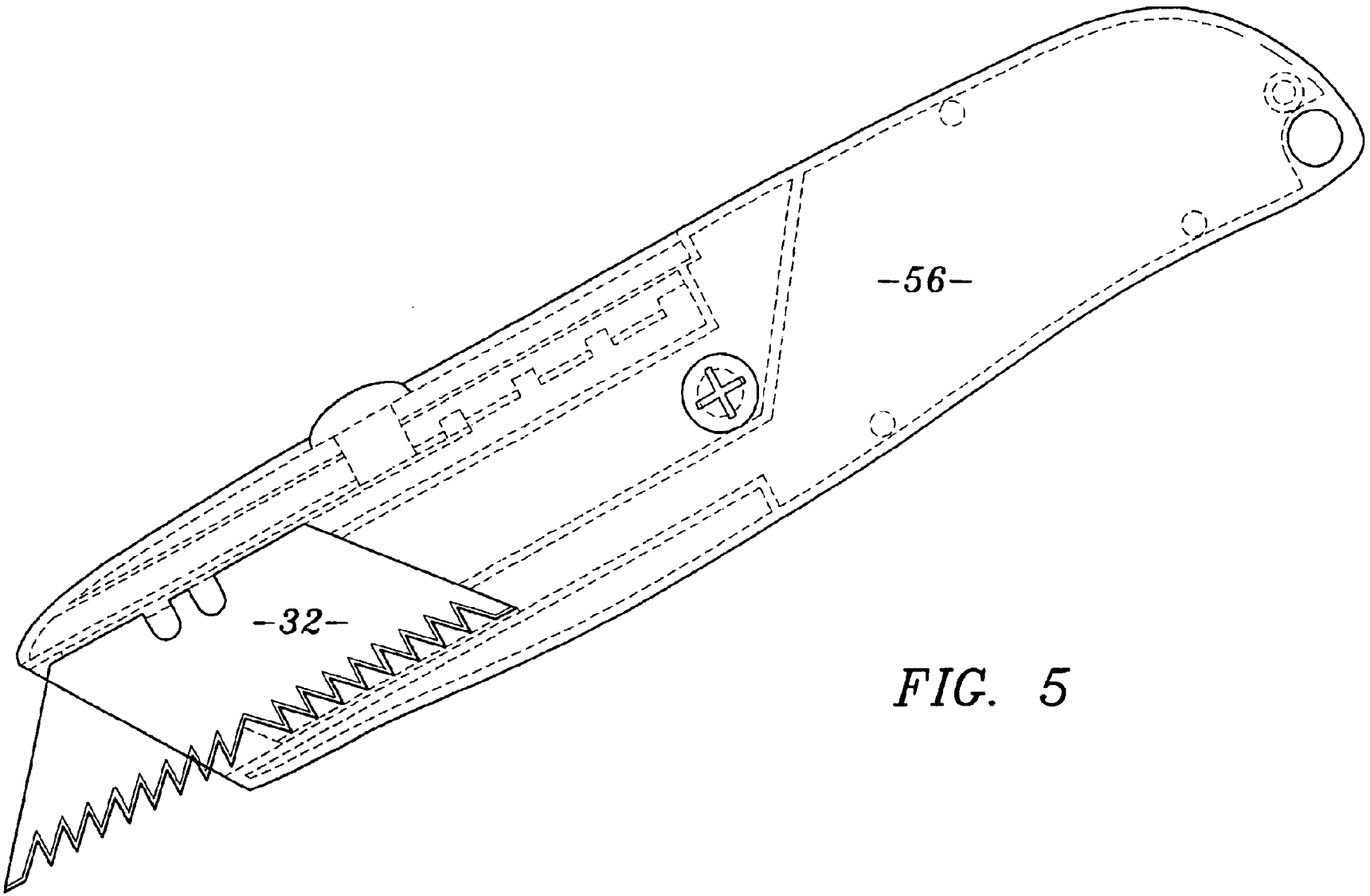
FIG. 5 is a perspective view of the blade of FIG. 1 installed in a utility knife handle.

Blade 30 further comprises a mid-point defined by a plane normal to front surface 32 and equidistant between left side 40 and right side 42. As one can see in the views of FIGS. 1, 3 and 5, the relative positions of first serration side 48 and second serration side 50 on each of the teeth 44 is reversed on opposite sides of the mid-point. Thus, in this first embodiment 30, a valley 52 is defined by the intersection of the first serration side 48 on one tooth 44 with the second serration side 50 of an adjacent tooth 44. A mid-point valley 54 is defined at the mid-point plane of body 30. By virtue of this construction, blade body 30 may be removed from its holder, such as, for example, utility knife 56 as shown in the view of FIG. 5, and reversed for subsequent use once the left portion of body 30 has dulled.

Finally, with particular regard to body 30, it can be seen that a pair of flat teeth 58 are provided with one of the flat teeth 58 adjacent left side 40 and the other adjacent right side 42. Planar edge 60 of each flat tooth 58 is sharpened and lies along a plane congruent with bottom edge 38.

It can also be seen that a pair of notches 62 are formed in substantially mirror image relation with respect to the mid-point of body 30 along top edge 36. The notches 62 are illustrated as examples of how such blade bodies 30 are typically inserted into and held by a utility knife 56. Notches 62 are, therefore, exemplary, and not deemed to be limiting to the scope of the present invention.

Having thus set forth the elements of a first embodiment of this invention, as illustrated by the structure of body 30, attention is now invited to the following examples of more specific construction and materials details. However, it is to be understood that the following details are provided for the purpose of clearly and distinctly describing this invention, and such details are not to be interpreted as limiting the scope of the present invention. It is also to be understood that the following details are applicable to the additional embodiments of this invention as more fully described hereinafter.

All embodiments of the present invention are preferably formed from a suitable material for retaining a sharpened edge, and, when that material is metal, the body preferably has a thickness of at least 0.0156 inches and preferably not greater than about 0.0313 inches. What might be characterized as "heavy-duty" is approximately 0.025 inches thick, and the thickness for what might be characterized as a "regular duty" blade is approximately 0.017 inches. The unique configuration of the teeth of each embodiment, as described above with regard to teeth 44 and as illustrated by first serration sides 48 and second serration sides 50 provides a cutting edge that, in actual use, appears to remain sharpened longer than a single flat edge cutting surface and is observed to significantly reduce the collection of cut material in the valleys 52, resulting in a serrated cutting blade that is much more suitable for industrial use than similar tests conducted with state-of-the-art cutting blades. The angle defined by valleys 52 is preferably in the range of about 45° to about 47°. Spacing between adjacent distal ends 46 is preferably in the range of about 0.110 inches to about 0.143 inches. In those embodiments including at least one planer edge 60, the length of the planer edge 60 preferably falls in the range of about 0.03125 inches to about 0.5 inches, with about 0.125 inches preferred.

The exact shape and size of the improved serrated cutting blade of this invention is determined with regard to the form of handle or holder into which the blade will be operatively mounted. Thus, the scope of this invention is not to be limited by overall size or shape. In similar fashion, means for attaching the blade of this invention to a holder or handle will be determined by the structural characteristics of the particular holder or handle, and the presence or absence of such features is not considered to limit the scope of the invention. Having thus provided additional details concerning the structure of the improved serrated cutting blade of this invention, attention is once again invited to the drawing figures and the following detailed description of alternative preferred embodiments.

In the following detailed description of additional embodiments, while similar structural elements will be identified by reference numerals already specified with regard to the first preferred embodiment of FIGS. 1–5, subsequent embodiments will have their structural elements identified in the following fashion. The preferred second embodiment will include reference numerals in a 200 series; the third preferred embodiment will have reference numerals in a 300 series; and subsequent embodiments will be likewise identified in a X00 series.

The views of FIGS. 6 through 9 depict a second preferred embodiment comprising a body generally indicated as 230. The structure of body 230 differs from that of the first preferred embodiment described above in that the orientation of the first serration sides 248 and second serration sides 250 are constant along the length of bottom edge 238. All other structural elements of this second preferred embodiment are identified by like reference numerals in the 200 series.

Figure 10:
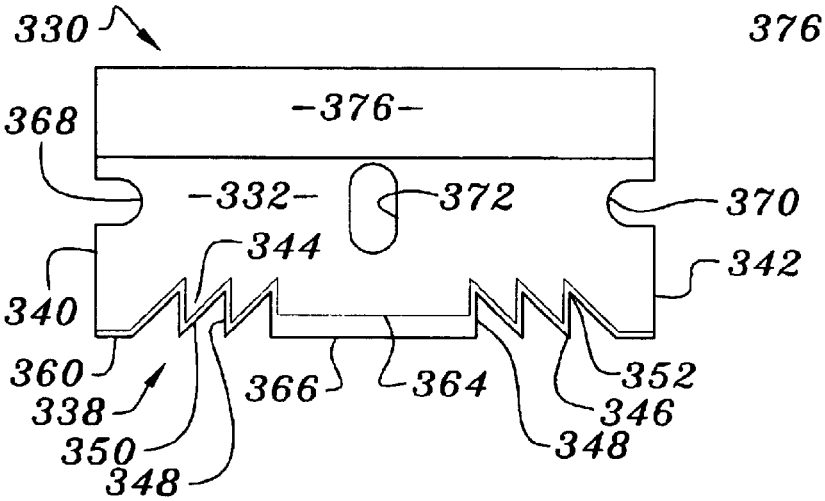
FIG. 10 is a front plan view of a third embodiment of the blade of this invention.
Figure 11:
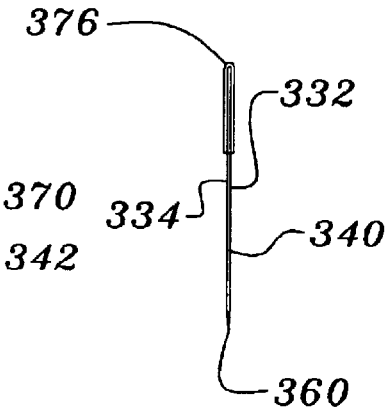
FIG. 11 is a left side elevation of the blade shown in FIG. 10.
Figure 14:
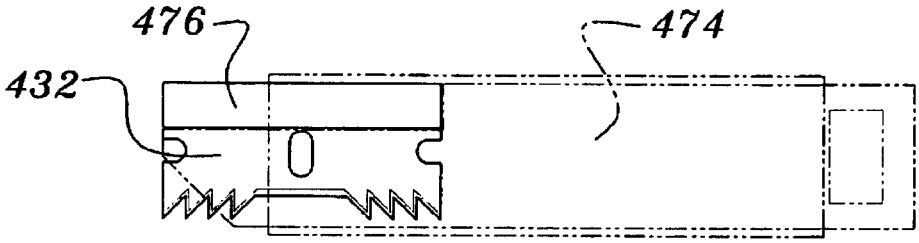
FIG. 14 is a front plan view of the blade of FIG. 12 installed in a holder, which is shown in phantom.

The views of FIGS. 10 and 11 depict a third preferred embodiment comprising a body generally indicated as 330. One can see that body 330 basically takes the form and shape, with the exception of bottom edge 338, of a single edge razor blade. In the embodiment of FIGS. 10 and 11, a segment on each side of the body 330 mid-point, as described and defined above, has no teeth 344. This segment is identified by reference numeral 364, and distal edge 366 is sharpened and lies along the same plane as that defined by bottom edge 338. Left notch 368, right notch 370, and central aperture 372 are provided in body 330 for the purpose of operatively attaching this third embodiment of the cutting blade of this invention into a suitable holder or handle such as that illustrated in phantom and designated by the referenced numeral 474 in FIG. 14. Finally, in accord with state-of-the-art construction for single edge razor blades, a reinforcing strip 376 extends across top edge 336 onto front surface 332 and back surface 334.

Figure 12:
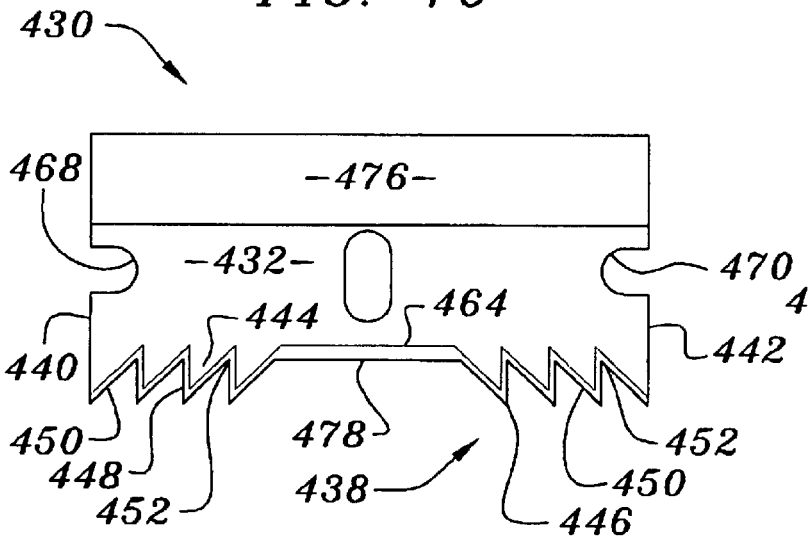
FIG. 12 is a front plan view of a fourth embodiment of the blade of this invention.
Figure 13:
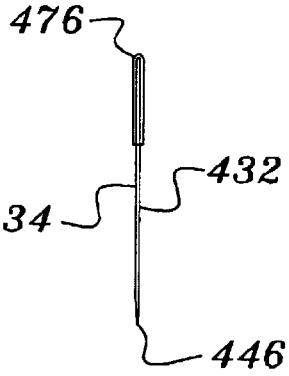
FIG. 13 is a left side elevation of the blade of FIG. 12.

The views of FIGS. 12 and 13 illustrate a fourth preferred embodiment of the invention comprising a body generally indicated as 430. While body 430 does include a segment 464 having no teeth 444, segment 464 is relieved, resulting in an edge 478 that is spaced inwardly from bottom edge 438. In all other respects the embodiment of body 430 is substantially similar to the embodiment of body 330, and the remaining structural features correspond to those identified above with regard to the first embodiment of body 30, but are identified by reference numerals in the 400 series. The fourth embodiment of FIGS. 12 and 13 is illustrated as being operatively attached to a handle or holder 474 in the view of FIG. 14.

Figure 15:
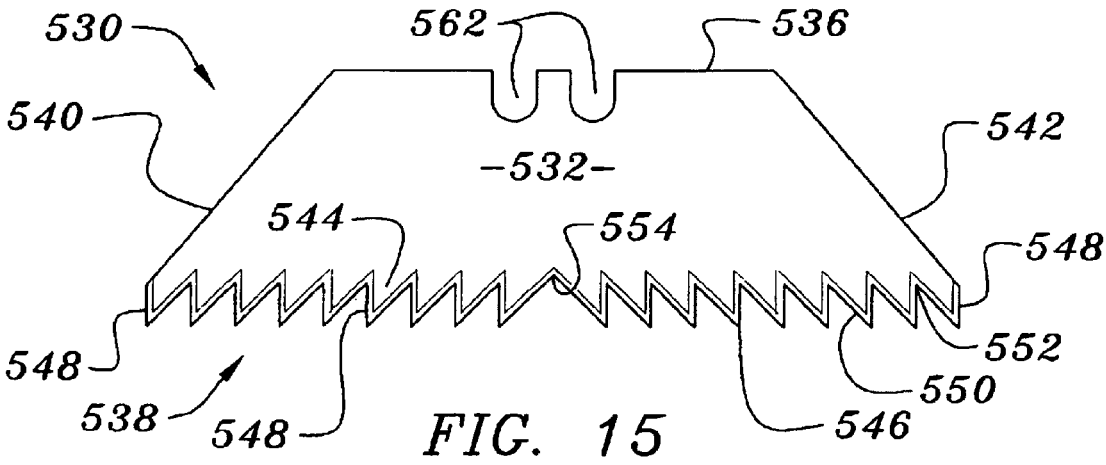
FIG. 15 is a front plan view of a fifth embodiment of the blade of this invention.

The embodiment of FIG. 15, comprising a body generally indicated as 530, is substantially similar to the first embodiment of FIG. 1 with two differences. Body 530 does not include any structure corresponding to flat teeth 58 as shown in FIG. 1. In addition, the outermost teeth 544 of the embodiment in FIG. 15 do include sharpened first serration sides 548.

Figure 16:
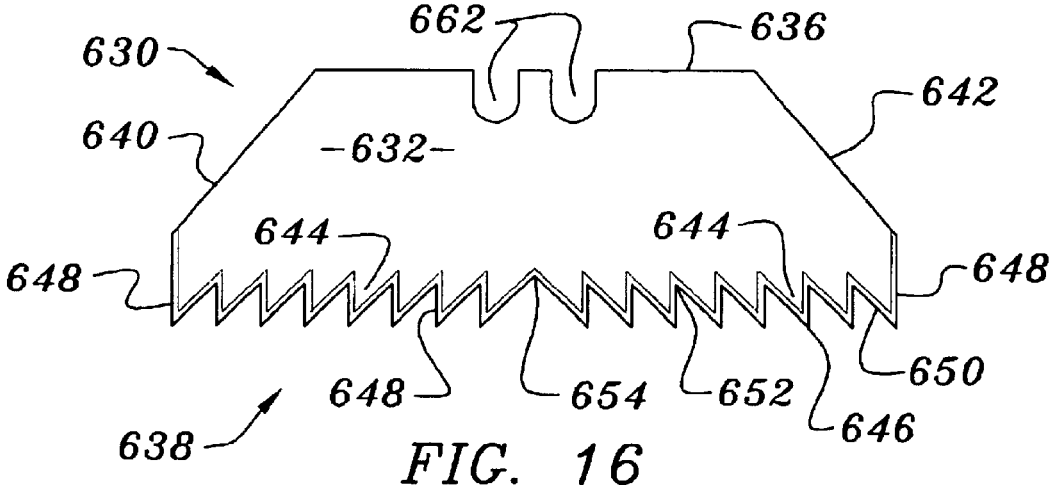
FIG. 16 is a front plan view of a sixth embodiment of the blade of this invention.

In the view of FIG. 16, a further embodiment for body 630 is shown wherein the outermost teeth 644 include a sharpened first serration side 648 that is simply larger than the first serration side 548 of the embodiment in FIG. 15, and this is provided by a modification of body 630 so that left side 640 and right side 642 define a larger angle with respect to the plane of top edge 636.

Figure 17:
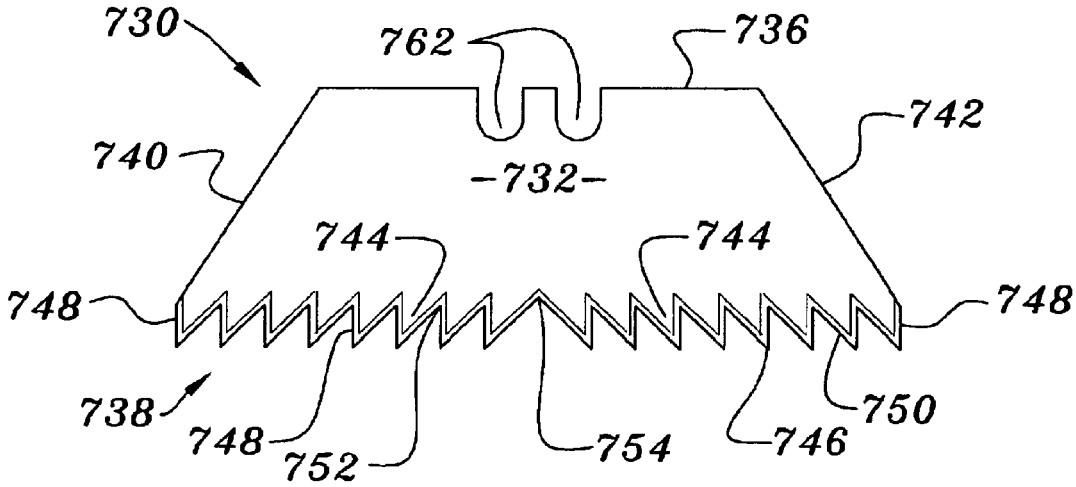
FIG. 17 is a front plan view of a seventh embodiment of the blade of this invention.

The embodiment of FIG. 17, comprising a body generally indicated as 730, is substantially similar to the embodiment of FIG. 15, but has fewer teeth 744 along bottom edge 738.

Figure 18:
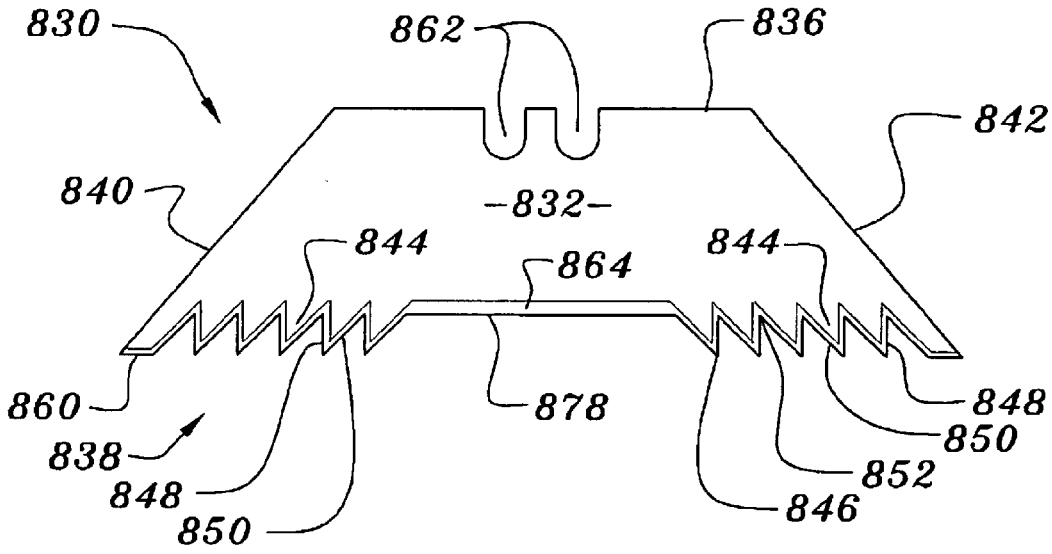
FIG. 18 is a front plan view of an eighth embodiment of the blade of this invention.

Referring to the view of FIG. 18, the embodiment comprising a body generally indicated as 830 can be seen as a "combination" of the embodiment illustrated in FIG. 1 and the relieved segment 864 corresponds to segment 464 as shown in the view of FIG. 12.

Figure 19:
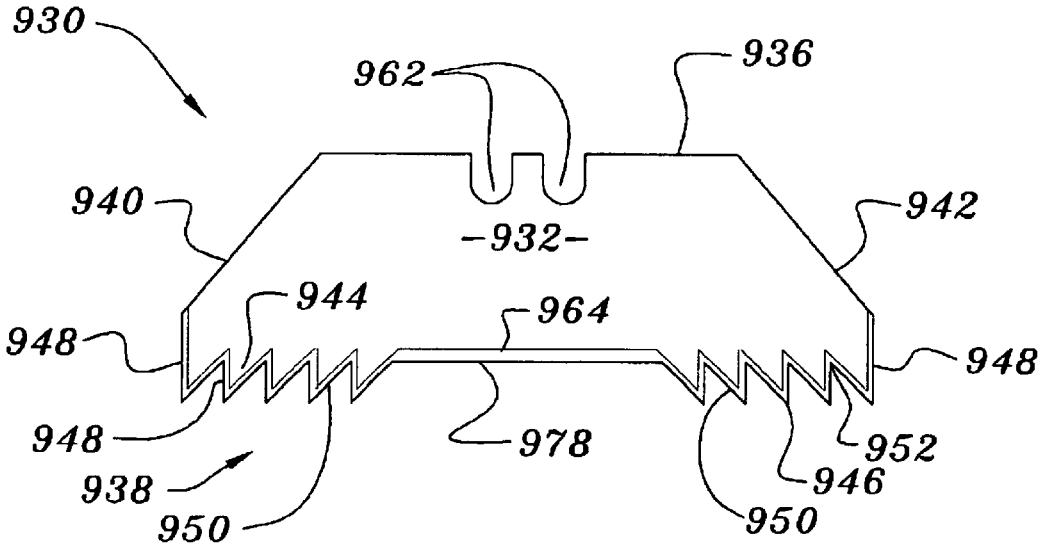
FIG. 19 is a front plan view of a ninth embodiment of the blade of this invention.

The embodiment of FIG. 19, comprising a body generally indicated as 930, is substantially similar to the embodiment of FIG. 16 with the inclusion of a relieved segment 964.

In summary, while a variety of embodiments for the improved serrated cutting blade of this invention are shown, the various structures and configurations presented are provided as but limited examples of the scope of the present invention, and are not themselves to be interpreted as limiting. It is also to be noted that distal edge 366 and the edges designated as 478, while being shown and described as sharpened, need not be sharpened to fall within the intended scope of the present invention.

It will thus be seen that the objects set forth above, among those made apparent from the preceding description, are efficiently attained, and, since certain changes may be made in the above article without departing from the scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. An improved serrated cutting blade, said blade comprising a body defined by a front surface, a back surface, opposed top and bottom edges, and opposed left and right sides, said bottom edge comprising a plurality of sharpened teeth, adjacent ones of said plurality of teeth defining a valley therebetween, each of said plurality of teeth having a distal end extending away from said body such that a line connecting each of said distal ends defines said bottom edge, and each of said plurality of teeth comprising a first serration side and a second serration side, said valleys being defined by the intersection of said first serration side of one of said teeth and said second serration side of an adjacent one of said teeth, the angle of said first serration side being less than the angle of said second serration side, both of said angles being measured with respect to a plane normal to said bottom edge between adjacent ones of said distal ends, and said blade further comprising a mid-point defined by a plane normal to said front surface and equidistant between said left and right sides, said first serration side of each of said teeth being on opposite tooth sides on opposite sides of said mid-point.

2. An improved serrated cutting blade as in claim 1 wherein said blade further comprises a segment on each side of said mid-point having no teeth.

3. An improved serrated cutting blade as in claim 2 wherein said segment is sharpened.

4. An improved serrated cutting blade as in claim 2 wherein said segment is relieved to define a relieved segment bottom edge that is spaced inwardly toward said top edge.

5. An improved serrated cutting blade as in claim 4 wherein said relieved segment is sharpened.

6. An improved serrated cutting blade as in claim 1 further comprising at least one flat tooth having a flat tooth side that is congruent with one of said left and right sides and having a planar sharpened edge that is congruent with said bottom edge.

7. An improved serrated cutting blade as in claim 1 further comprising a pair of flat teeth, one of said teeth being positioned adjacent said left side and the other of said teeth being positioned adjacent said right side, each one of said teeth having flat tooth side that is congruent with its corresponding left and right side and each one of said teeth having a planar sharpened edge that is congruent with said bottom edge.

8. An improved serrated cutting blade as in claim 7 wherein said flat tooth sides are sharpened.

9. An improved serrated cutting blade as in claim 1 wherein said blade further comprises a mid-point defined by a plane normal to said front surface and equidistant between said left and right sides, said blade further comprising a segment on each side of said mid-point having no teeth.

10. An improved serrated cutting blade as in claim 9 wherein said segment is sharpened.

11. An improved serrated cutting blade as in claim 8 wherein said segment is relieved to define a relieved segment bottom edge that is spaced inwardly toward said top edge.

12. An improved serrated cutting blade as in claim 11 wherein said relieved segment is sharpened.

13. An improved serrated cutting blade as in claim 9 further comprising at least one flat tooth having a flat tooth side that is congruent with one of said left and right sides and having a planar sharpened edge that is congruent with said bottom edge.

14. An improved serrated cutting blade as in claim 9 further comprising a pair of flat teeth, one of said teeth being positioned adjacent said left side and the other of said teeth being positioned adjacent said right side, each one of said teeth having a flat tooth side that is congruent with its corresponding left and right side and each one of said teeth having a planar sharpened edge that is congruent with said bottom edge.

15. An improved serrated cutting blade as in claim 14 wherein said flat tooth sides are sharpened.

16. An improved serrated cutting blade as in claim 1 further comprising at least one flat tooth having a flat tooth side that is congruent with one of said left and right sides and having a planar sharpened edge that is congruent with said bottom edge.

17. An improved serrated cutting blade as in claim 1 further comprising a pair of flat teeth, one of said teeth being positioned adjacent said left side and the other of said teeth being positioned adjacent said right side, each one of said teeth having a flat tooth side that is congruent with its corresponding left and right side and each one of said teeth having a planar sharpened edge that is congruent with said bottom edge.

18. An improved serrated cutting blade as in claim 17 wherein said flat tooth sides are sharpened.

* * * * *

UNITED STATES PATENT AND TRADEMARK OFFICE

CERTIFICATE OF CORRECTION

PATENT NO. : 6,823,593 B2
DATED : November 30, 2004
INVENTOR(S) : Dunn-Rankin, Michael It is certified that error appears in the above-identified patent and that said Letters Patent is hereby corrected as shown below:

Column 6,
Line 25, “8” should be -- 9 --.

Signed and Sealed this

Twenty-second Day of February, 2005

JON W. DUDAS
*Director of the United States Patent and Trademark Office*